US011413894B2

(12) United States Patent
Schmitt-Lewen

(10) Patent No.: US 11,413,894 B2
(45) Date of Patent: Aug. 16, 2022

(54) METHOD FOR PRODUCING A PRINTED PRODUCT

(71) Applicant: HEIDELBERGER DRUCKMASCHINEN AG, Heidelberg (DE)

(72) Inventor: Martin Schmitt-Lewen, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 492 days.

(21) Appl. No.: 16/590,936

(22) Filed: Oct. 2, 2019

(65) Prior Publication Data

US 2020/0101780 A1 Apr. 2, 2020

(30) Foreign Application Priority Data

Oct. 2, 2018 (DE) ..... 10 2018 216 927.6

(51) Int. Cl.

| | |
|---|---|
| ***B41M 1/24*** | (2006.01) |
| ***B41F 23/04*** | (2006.01) |
| ***B41F 19/02*** | (2006.01) |
| ***B41M 1/14*** | (2006.01) |
| ***B41F 23/08*** | (2006.01) |
| *B41M 1/04* | (2006.01) |
| *B41M 7/00* | (2006.01) |

(52) U.S. Cl.

CPC ..... *B41M 1/24* (2013.01); *B41F 19/02* (2013.01); *B41F 23/0409* (2013.01); *B41F 23/08* (2013.01); *B41M 1/14* (2013.01); *B41M 1/04* (2013.01); *B41M 7/009* (2013.01); *B41M 7/0081* (2013.01)

(58) Field of Classification Search

CPC .. B41M 1/04; B41M 1/14; B41M 1/24; B41F 19/02; B41F 23/0409; B41F 23/08

See application file for complete search history.

(56) References Cited

U.S. PATENT DOCUMENTS

| | | | | |
|---|---|---|---|---|
| 1,907,094 A * | 5/1933 | Smith | C23D 5/06 427/427 |
| 3,355,312 A * | 11/1967 | Coney | B05D 5/062 428/152 |
| 5,324,546 A * | 6/1994 | Crutchley | B44D 2/00 427/256 |
| 6,546,872 B1 | 4/2003 | Huffer et al. | |
| 7,856,926 B2 | 12/2010 | Thal | |
| 8,372,731 B2 | 2/2013 | Li et al. | |

(Continued)

FOREIGN PATENT DOCUMENTS

| | | |
|---|---|---|
| CN | 101034667 A | 9/2007 |
| CN | 103660650 A | 3/2014 |

(Continued)

*Primary Examiner* — Jill E Culler

(74) *Attorney, Agent, or Firm* — Laurence A. Greenberg; Werner H. Stemer; Ralph E. Locher

(57) ABSTRACT

A method produces a printed product. The method includes transferring a first Fluid onto at least one section of printing stock, applying a second fluid, having a dewetting effect on the first fluid, onto a form configured as a relief printing form or embossing form, and transferring the second fluid to at least some points of the section. In this manner printed products of high quality can be produced.

10 Claims, 3 Drawing Sheets

(56) References Cited

U.S. PATENT DOCUMENTS

| | | | | |
|---|---|---|---|---|
| 8,471,879 | B2 * | 6/2013 | Kanazawa | B41M 1/24 347/171 |
| 8,993,103 | B2 | 3/2015 | Clauter et al. | |
| 2006/0026637 | A1 | 2/2006 | Gatto et al. | |
| 2011/0111118 | A1 | 5/2011 | Schmitt-Lewen et al. | |

FOREIGN PATENT DOCUMENTS

| | | | |
|---|---|---|---|
| CN | 107443943 | A | 12/2017 |
| DE | 10362054 | A1 | 7/2005 |
| DE | 102006021314 | A1 | 12/2006 |
| DE | 102010047926 | A1 | 5/2011 |
| DE | 102010054528 | A1 | 6/2012 |
| DE | 102013021180 | A1 | 6/2015 |
| EP | 1211095 | A1 | 6/2002 |
| EP | 2902201 | A2 | 8/2015 |
| JP | 2002225413 | A | 8/2002 |
| JP | 2007518594 | A | 7/2007 |
| JP | 2008037100 | A | 2/2008 |
| JP | 2014128949 | A | 7/2014 |
| JP | 2015063113 | A | 4/2015 |

* cited by examiner

METHOD FOR PRODUCING A PRINTED PRODUCT

CROSS-REFERENCE TO RELATED APPLICATION

This application claims the priority, under 35 U.S.C. § 119, of German application DE 10 2018 216 927.6, filed Oct. 2, 2018; the prior application is herewith incorporated by reference in its entirety.

BACKGROUND OF THE INVENTION

Field of the Invention

The invention relates to a method having the features of the independent claim.

The invention is in the technical area of the graphics industry and in particular therein in the area of finishing printed products and/or producing high-grade finished and thus high-quality printed products.

Diverse methods for finishing printed products are known from the prior art, thus, for example, (spot) lacquering, the so-called "drip off" method, or embossing.

A method for creating three-dimensional patterns in coatings is known from published, non-prosecuted German patent application DE 10 2010 054 528 A1, corresponding to U.S. Pat. No. 8,993,103. A device and a method for producing a structured surface on a printing stock are known from published, European patent application EP 2 902 201 A2. A method for producing a valuable document and a device for carrying out the method are known from published, non-prosecuted German patent application DE 10 2013 021 180 A1.

The market for high-end finished and high-quality printed products always demands further improvements and also innovations to distinguish oneself from the competition with such printed products, for example, in the field of packages for luxury articles.

Aside from this field, prior art for conveying printing stock is known, for example, from published, non-prosecuted German patent application DE 10 2006 021 314 A1, corresponding to U.S. patent publication No. 2006/0266237. This describes a so-called "jacket" for guiding printing stock. The jacket contains a rough surface structure and therefore can create flaws, so-called "white dots", in the printed product. The document teaches applying an auxiliary liquid to the jacket, which assists the reclosing of the flaws.

SUMMARY OF THE INVENTION

It is therefore a problem of the invention to provide a method improved over the prior art, which enables in particular printed products of high quality to be produced.

This problem is solved according to the invention by a method having the feature combination of the independent method claim. Advantageous and therefore preferred refinements of the invention result from the dependent claims and also from the description and the drawings. The features of the invention, the refinements of the invention, and the exemplary embodiments of the invention also represent advantageous refinements of the invention in combination with one another.

The invention relates to a method for producing a printed product, having the following steps: transferring a first fluid onto at least one section of a printing stock; applying a second fluid—which has a dewetting effect on the first fluid—to a form configured as a relief printing form, for example, a flexographic printing form, or embossing form; and transferring the second fluid at at least some points of the section.

The invention advantageously enables printed products of high quality to be produced. A defined structure ("embossed pattern") can be created and preferably fixed by curing using the invention in a simple and reliable manner, which does not have any perceptible flaws, in particular due to uncontrolled running of the pattern before the fixing.

The dewetting effect can preferably be achieved as follows: The first fluid is provided having a surface tension in the range of 30 to 40 mN/m and particularly preferably in the range between 30 and 35 mN/m. The second fluid is preferably provided having a surface tension in the range of 18 to 30 mN/m and particularly preferably in the range between 20 and 25 mN/m. The difference of the surface tensions of the provided fluids is preferably selected to be as large as possible in this case and is preferably selected in the range between 8 and 12 mN/m. A sufficient stabilization of the created structure can be achieved in this way.

The method according to the invention offers the advantage over the known "drip off" method that the created structure is more defined and stable, in particular if embossing is performed under compression. The advantage exists over published, non-prosecuted German patent application DE 10 2010 054 528 A1 that the transfer of the second fluid at the points of the section of the printing stock and thus the structuring of the first fluid takes place in one step. The advantage exists over published European patent application EP 2 902 201 A2 that hardly any material application is performed by the second fluid. The difference exists in relation to published, non-prosecuted German patent application DE 10 2013 021 180 A1 that the transfer is performed using raised structures. The invention differs in principle from published, non-prosecuted German patent application DE 10 2006 021 314 A1, because according to the invention, running of the created, in particular embossed structure is to be avoided, while on the contrary the running is promoted in the prior art.

A further advantage of the invention can be seen in that the dewetting effect of the second fluid prevents the form for transferring the second fluid from being soiled and/or contaminated with the first fluid during the production of printed products and the quality of the produced printed products suffering as a result.

Preferred refinements of the invention can be distinguished by one or more of the feature combinations listed hereafter.

The second fluid is transferred while the first fluid is not yet or not substantially dried and/or cured.

The second fluid is pressed or embossed into the first fluid under compression.

The second fluid touches the printing stock at the points of the section and displaces the first fluid therein.

The second fluid reduces or prevents flowing back of the first fluid at the points of the section.

The second fluid structures the first fluid in accordance with a structure of the form.

The first fluid is transferred over the entire area in the section.

The first fluid is dried and/or cured after the transfer of the second fluid. The second fluid can also be dried and/or cured. The first and the second fluid can be dried and/or cured, preferably jointly, after the transfer of the second fluid.

The first fluid and/or the second fluid is provided as a lacquer.

The printing stock is printed before the transfer of the first fluid.

Other features which are considered as characteristic for the invention are set forth in the appended claims.

Although the invention is illustrated and described herein as embodied in a method for producing a printed product, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
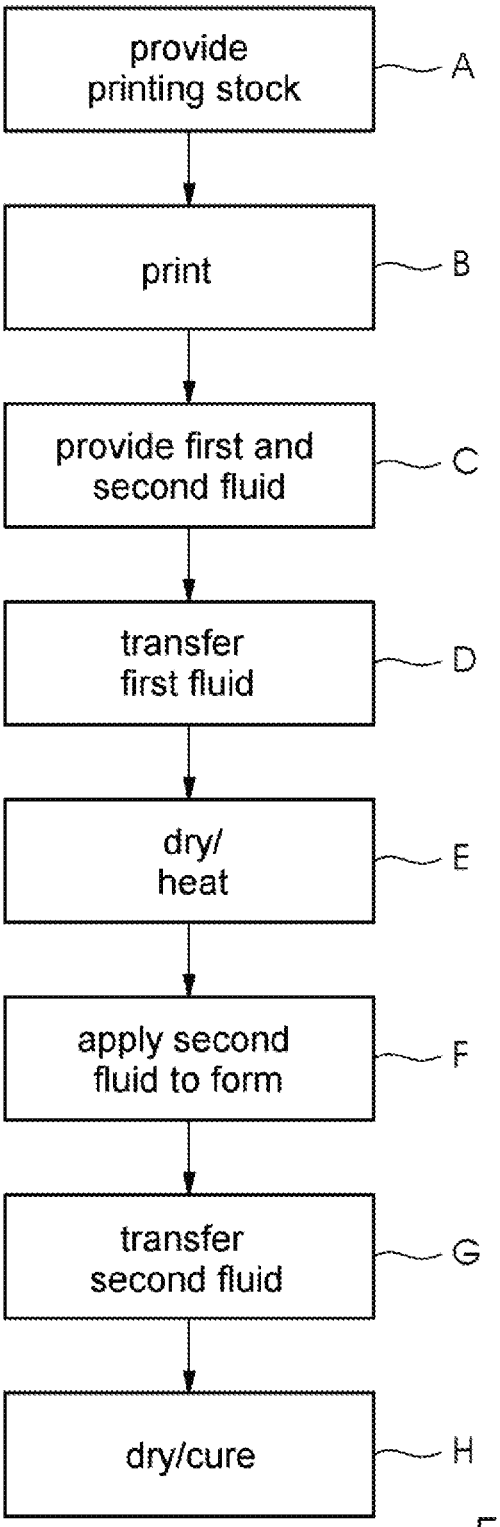
FIG. 1 is a flow chart of a preferred embodiment of the method according to the invention.
Figure 2:
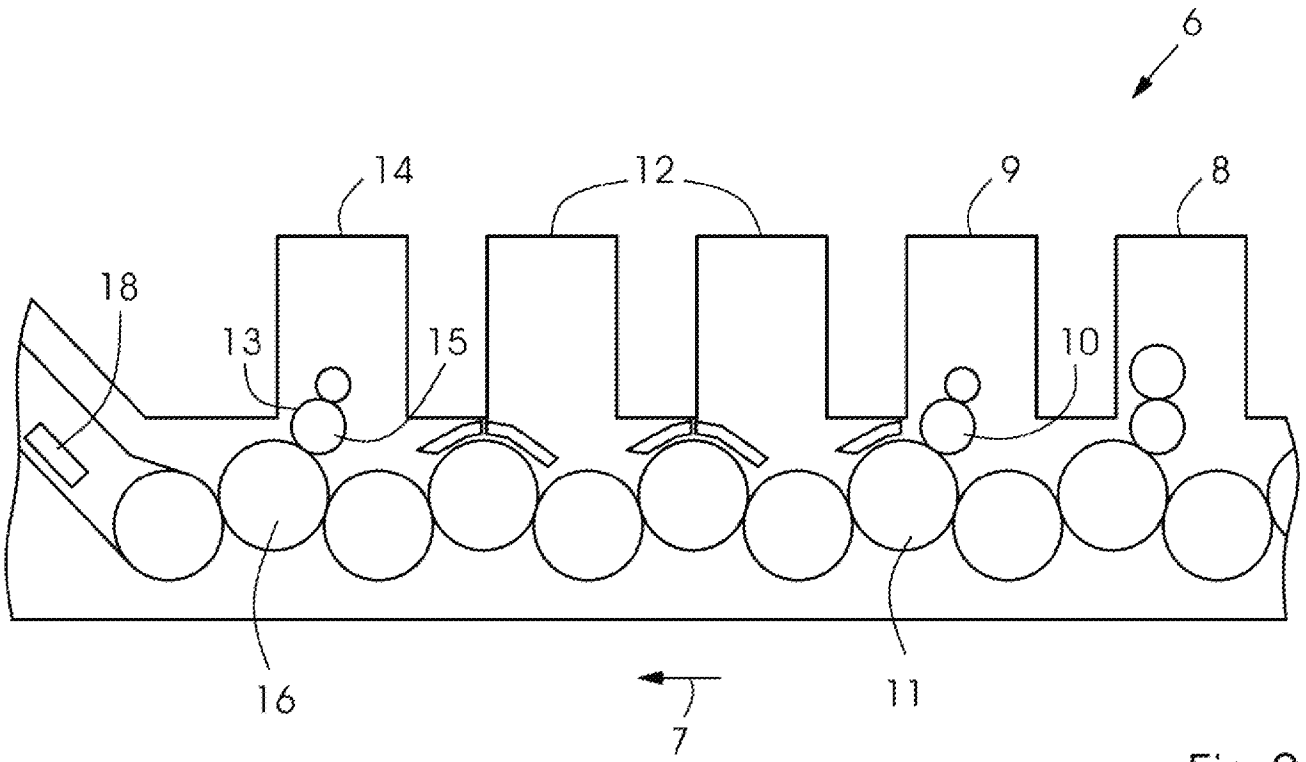
FIG. 2 is a diagrammatic, side view of a printing press for carrying out the method according to the invention.

Referring now to the figures of the drawings in detail and first, particularly to FIG. 1 thereof, there is shown a flow chart of a preferred embodiment of the method according to the invention having method steps A to H for producing a printed product 1*a* from printing stock 1*b*. The method steps are explained hereafter. In this case, reference is also made to FIG. 2, which shows by way of example a sheet-processing printing press 6 for carrying out the method according to the invention, and also FIG. 3, which in particular shows the transfer of a second fluid (method step F).

In method step A, the printing stock 1*b* is provided, for example, paper, cardboard, paperboard, plastic film, or metal foil (each preferably as a sheet or alternatively as a web). The provision can preferably take place as a sheet stack in a non-illustrated feeder of the printing press 6. Alternatively, a metal plate can also be provided.

In optional method step B, the printing stock 1*b* is optionally printed. The printing preferably takes place in at least one printing mechanism 8 of the printing press 6, preferably in four offset printing mechanisms (CMYK printing method). After the printing, drying and/or curing can take place, for example, in a drying mechanism (not shown) directly after the printing mechanism, preferably in a UV drying mechanism.

In method step C, a first fluid 2 and a second fluid 3 are provided. The first fluid is preferably provided as a lacquer and is preferably provided in a first lacquering mechanism 9 of the printing press 6. The second fluid is preferably also provided as a lacquer and is preferably provided in a second lacquering mechanism 14 of the printing press.

The first fluid 2 is preferably provided as a UV-curable lacquer ("UV lacquer"), for example, as the lacquer sold under the name "Saphira U8730". UV lacquer has the advantage here that it only loses little volume (upon curing) and the structure introduced according to the invention and/or corresponding embossing effects are therefore more distinctive.

The first fluid 2 can be a clear lacquer, a flexographic ink, a metallic lacquer, a lacquer having effect pigments, a fluorescent lacquer, a matte lacquer, or a colored lacquer.

In method step D, the first fluid 2 is transferred onto at least one section 4 of the printing stock 1*b*. The transfer is preferably performed by the first lacquering mechanism 9 and/or by a first cylinder 10 and a first counter cylinder 11 of the mechanism. The mechanism 9 can be a so-called Anicolor mechanism and the transfer can be performed by a flexographic form. Alternatively, the mechanism can be an offset, gravure, screen, or inkjet mechanism. Furthermore, the first fluid can alternatively be applied via roller coating or spray lacquering.

Figure 3:
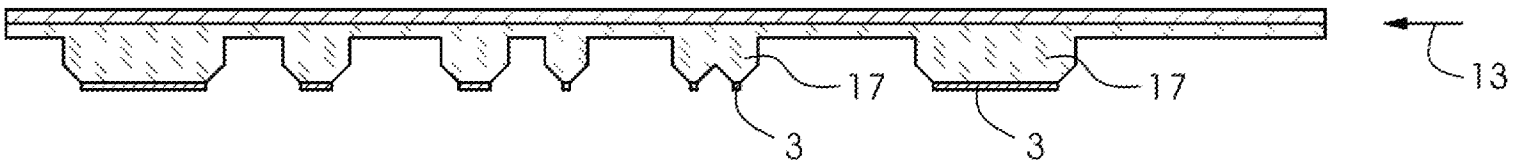
FIG. 3 is an illustration showing a transfer of a second fluid.
Figure 3:
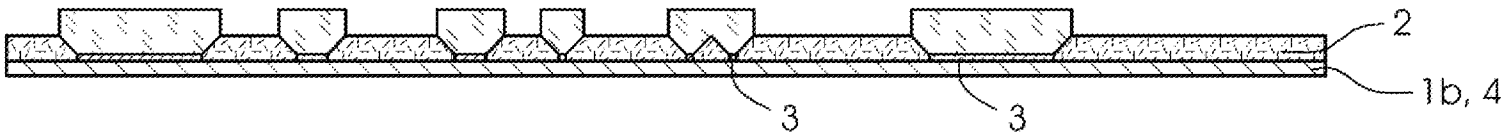
Figure 3:
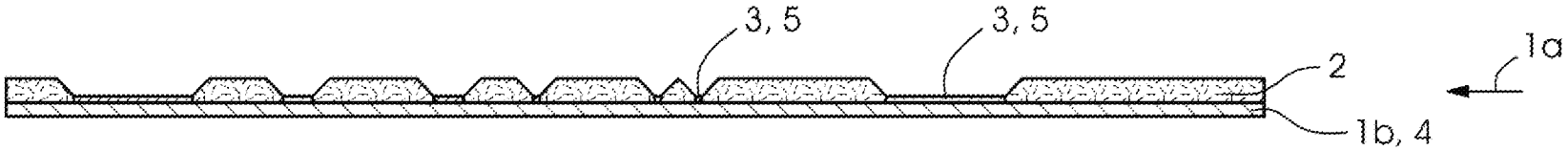

In FIG. 3, the printing stock 1*b* having the already transferred first fluid 2 is shown in the middle image. A layer thickness of 2 to 20 μm, particularly preferably of 5 to 10 μm, of the first fluid is preferably created on the printing stock. The first fluid is preferably transferred over the entire area in the section 4. Alternatively, a transfer is performed over only a partial area, for example, in the case of a so-called spot lacquering. After the transfer of the first fluid, the printing stock 1*b* is conveyed (further) in a transportation direction 7.

In optional method step E, radiation is optionally applied to the first fluid 2. This is preferably performed in at least one drying mechanism 12 of the printing press 6. The quality of the printed product 1*a* can possibly be improved by the application. For example, an excessively thin lacquer (as the first fluid 2) can be slightly dried and thus can become able to be better formed/embossed. Or, for example, a UV lacquer (as the first fluid) can be slightly heated and thus made more uniform. If such measures are not required, the method can also be carried out in a printing press 6 without drying mechanisms 12.

In method step F, the second fluid 3 is applied to a form 13. In this case, this is preferably a relief printing form, for example, a flexographic form, or an embossing form. The form 13 is preferably accommodated on a second cylinder 15 of a second lacquering mechanism 14 of the printing press 6. In FIG. 3, the form 13 is shown in the top image. It has protrusions 17, which bear the second fluid. The protrusions can be created in accordance with a pattern or image, and/or the form 13 is structured using the protrusions or forms a corresponding relief. The protrusions 17 can be soft and/or elastic, for example, if a flexographic form is used. Alternatively, the protrusions 17 can be hard, preferably in cases in which the counter cylinder is soft and/or the printing stock is compressible.

In method step G, the second fluid 3 (applied to the form 13) is transferred at at least some points 5 of the section 4 to the printing stock 1*b*. The transfer preferably takes place in a gap between the second cylinder 15 and a second counter cylinder 16. The method step of the transfer is recognizable in the middle and bottom images in FIG. 3. The protrusions 17 of the form 13 penetrate into the first fluid 2 and place the second fluid at the points 5.

The second fluid 3 is preferably transferred while the first fluid 2 is not yet or not yet substantially dried and/or cured and therefore can still be formed. The second fluid is thus preferably transferred through the still "wet" first fluid up to the printing stock.

The second fluid 3 is preferably pressed or embossed under compression into the first fluid 2, wherein the first fluid is preferably displaced, so that the second fluid preferably reaches the printing stock 1*b* or its surface.

The second fluid 3 preferably prevents or reduces flowing back of the first fluid 2, at least at the points 5. In this way, the layer made of first fluid is preferably structured in accordance with the structure of the form 13 and/or in accordance with the protrusions 17. This structure is advantageously substantially maintained (also in the temporary wet state of the first fluid).

The flowing back of the first fluid 2 is prevented according to the invention in that the second fluid 3 is used which has a dewetting effect on the first fluid. If, for example, "Saphira U8730" is used as the first fluid, a UV-curable lacquer, in particular for flexographic printing, for example, the lacquer sold under the name "Saphira U8780", can thus be used as the second fluid. The dewetting effect is substantially based on the different surface tensions of the first and the second fluid, wherein the surface tension of the first fluid is selected as greater than that of the second fluid. Examples: "Saphira U8730" has a measured surface tension between 30 and 32 mN/m and "Saphira U8780" of approximately 22 mN/m.

The second fluid 3 can be uncolored or colored and optionally also pigmented. The second fluid can be considered to be a dewetting fluid and/or a stabilization fluid and can be denoted accordingly.

Preferably, a layer thickness of 1 to 5 μm, particularly preferably of 2 to 3 μm, of the second fluid 3 is created on the printing stock 1*b*.

Figure 4:
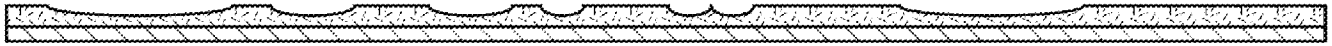
FIG. 4 is an illustration showing the prior art.

In FIG. 3, the bottom image shows how the layer made of first fluid 2 is structured by the transfer of the second fluid 3 having a dewetting effect and this structure is maintained. In comparison thereto, it is shown under this in FIG. 4 that an embossing procedure according to the prior art (i.e., without dewetting fluid) only creates a printed product of lower quality due to uncontrolled flowing back.

In method step H, the first fluid 2 is dried or cured after the transfer of the second fluid 3 (after method step G) and in this way the structuring (the "embossed image") is fixed. This is preferably performed by a dryer 18 during the further transportation of the printing stock 1*b* (for example, in a delivery unit (not shown in its entirety) of the printing press 6). Thermal drying can be performed (IR and/or hot air) and/or curing can be performed using UV. The second fluid 3 is preferably also dried and/or cured, particularly preferably by means of the same dryer.

When reading the claim language, the following definitions apply. When the claim language recites A and/or B it means A alone, B alone or A and B. When the claim language recites at least one of A and B it means A alone, B alone or A and B. When the claim language recites at least one of A or B it means A alone, B alone or A and B.

LIST OF REFERENCE SIGNS

1*a* printed product
1*b* printing stock
2 first fluid
3 second fluid
4 section
5 points
6 printing press
7 transportation direction
8 printing mechanism
9 first lacquering mechanism
10 first cylinder
11 first counter cylinder
12 drying mechanism(s)
13 form
14 second lacquering mechanism
15 second cylinder
16 second counter cylinder
17 protrusions/structure
18 dryer
A-H method steps

The invention claimed is:

1. A method for producing a printed product, which comprises the following steps of:
- transferring a first fluid onto at least one section of printing stock;
- applying a second fluid, having a dewetting effect on the first fluid, onto a form configured as a letterpress form or an embossing form; and
- transferring the second fluid to at least some points of the at least one section.

2. The method according to claim 1, which further comprises transferring the second fluid while the first fluid is not yet or is not yet substantially dried and/or cured.

3. The method according to claim 1, which further comprises pressing or embossing the second fluid into the first fluid under compression.

4. The method according to claim 1, wherein the second fluid touches the printing stock at the points and displaces the first fluid.

5. The method according to claim 1, wherein the second fluid reduces or prevents flowing back of the first fluid at the points.

6. The method according to claim 1, wherein the second fluid structures the first fluid in accordance with a structure of the form.

7. The method according to claim 1, which further comprises transferring the first fluid over an entire area of the section.

8. The method according to claim 1, which further comprises drying and curing the first fluid after a transfer of the second fluid.

9. The method according to claim 1, wherein at least one of the first fluid or the second fluid is a lacquer.

10. The method according to claim 1, which further comprises printing the printing stock before a transfer of the first fluid.

* * * * *